US008771050B2

(12) United States Patent
Buchner, III

(10) Patent No.: US 8,771,050 B2
(45) Date of Patent: Jul. 8, 2014

(54) GAME COUNTING NUMBERS CONSECUTIVELY USING MATH FUNCTIONS

(75) Inventor: Richard John Buchner, III, Snellville, GA (US)

(73) Assignee: Richard J. Buchner, III, Snellville, GA (US)

( * ) Notice: Subject to any disclaimer, the term of this patent is extended or adjusted under 35 U.S.C. 154(b) by 359 days.

(21) Appl. No.: 13/030,761

(22) Filed: Feb. 18, 2011

(65) Prior Publication Data

US 2011/0201399 A1 Aug. 18, 2011

Related U.S. Application Data

(60) Provisional application No. 61/305,915, filed on Feb. 18, 2010.

(51) Int. Cl.

| | |
|---|---|
| ***A63F 9/24*** | (2006.01) |
| ***A63F 13/00*** | (2014.01) |
| ***G06F 17/00*** | (2006.01) |
| ***G06F 19/00*** | (2011.01) |

(52) U.S. Cl.

USPC ..... 463/16; 273/146; 273/299; 273/430; 434/191

(58) Field of Classification Search

USPC ..... 463/16; 273/299, 146, 430; 434/191

See application file for complete search history.

(56) References Cited

U.S. PATENT DOCUMENTS

| | | | | |
|---|---|---|---|---|
| 4,281,835 | A * | 8/1981 | Seiden | 273/299 |
| 2003/0111794 | A1 * | 6/2003 | DiGirolamo et al. | 273/430 |
| 2004/0229196 | A1 * | 11/2004 | Ritchie | 434/191 |

* cited by examiner

*Primary Examiner* — Adetokunbo O Torimiro

(74) *Attorney, Agent, or Firm* — Morris, Manning & Martin, LLP; Daniel E. Sineway, Esq.; Bryan D. Stewart, Esq.

(57) ABSTRACT

A counting game played by one or more players involving numbers selected from pre-classified categories, suited to be played by players having different levels of mental maturity. A game involves choosing a set of numbers from one or more categories, at random. The object of the game is to generate numbers as high as possible, by using multiple math functions on the randomly generated chosen numbers. A player with the highest generated number wins the game. Apart from providing recreation and entertainment, the game develops math skills and provides mental training exercises, and can therefore be useful as a tool for educational and learning purposes.

20 Claims, 5 Drawing Sheets

Process of Playing an Exemplary Counting Game Using Numbered Cards

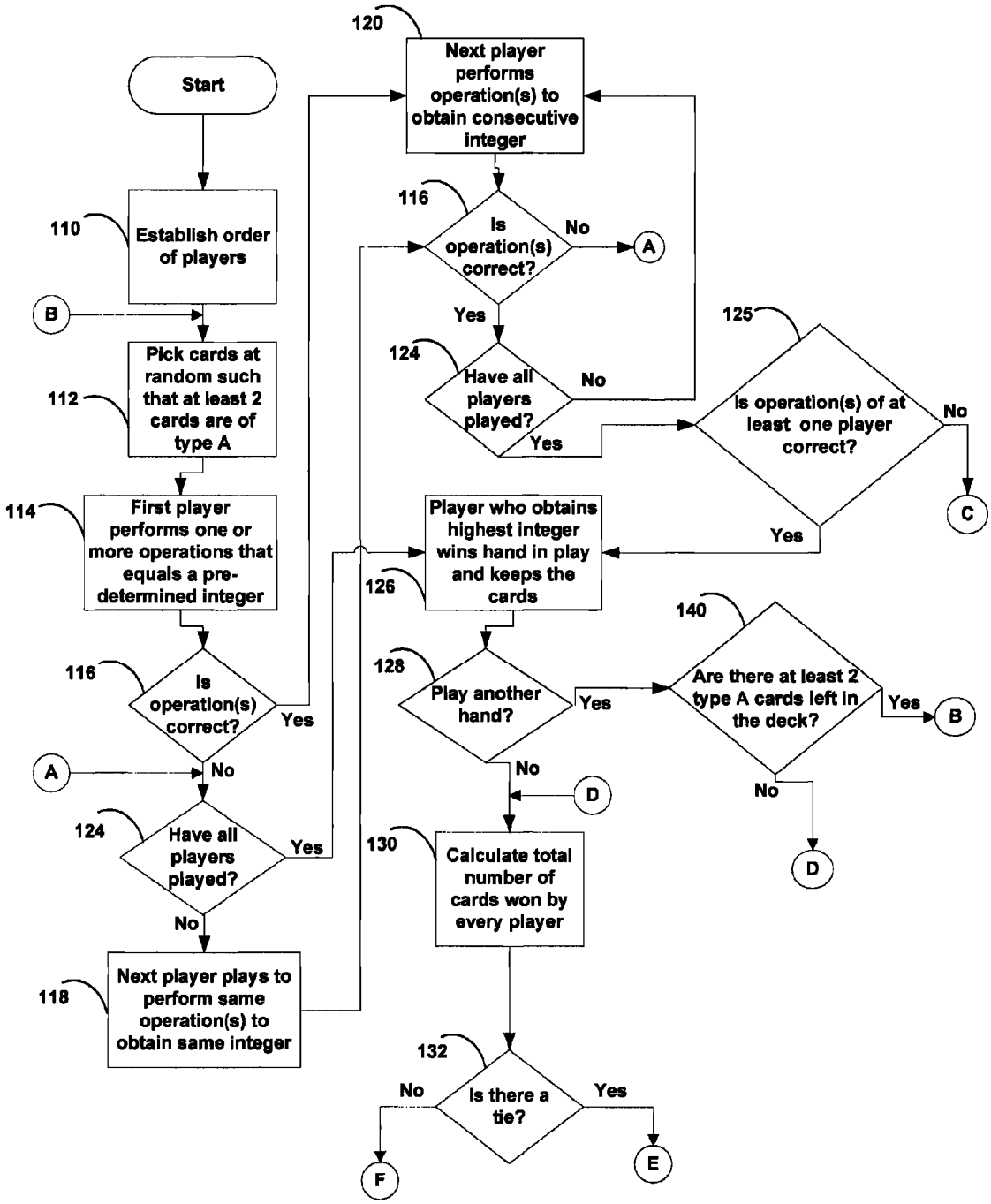
FIG. 1A - Process of Playing an Exemplary Counting Game Using Numbered Cards

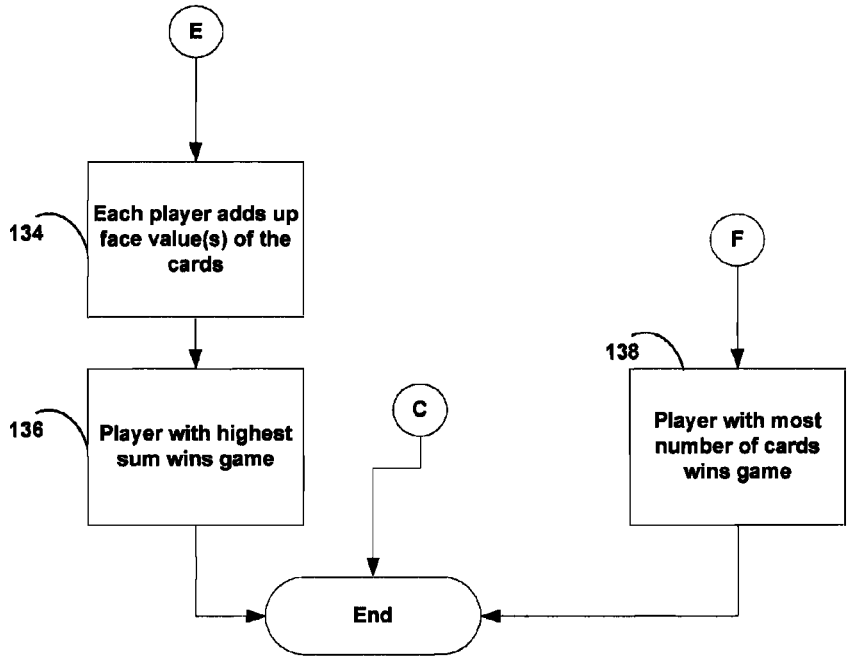
FIG. 1B - Process of Playing an Exemplary Counting Game Using Numbered Cards

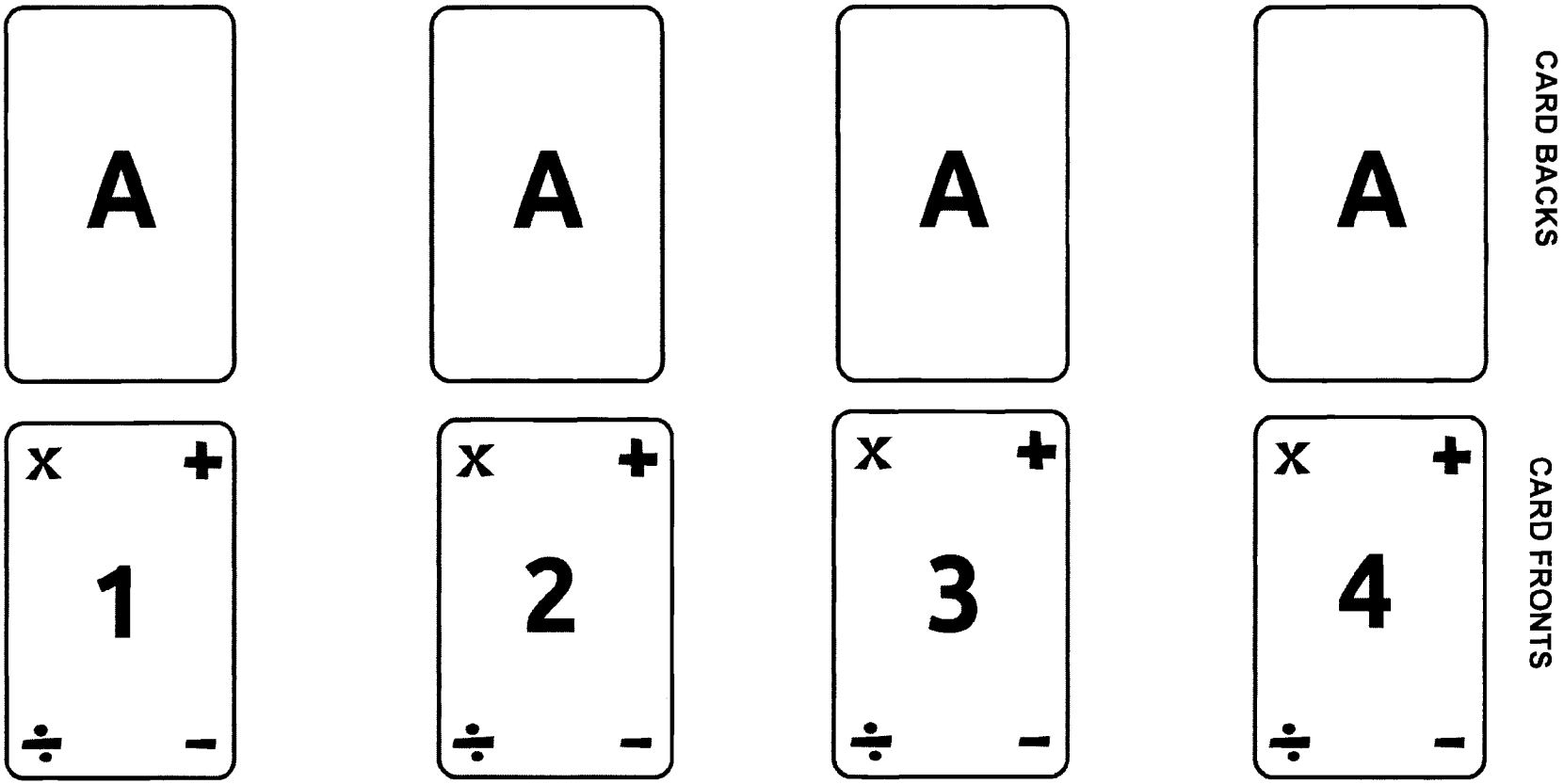
FIG. 2 - Exemplary Numbered Cards of Type A

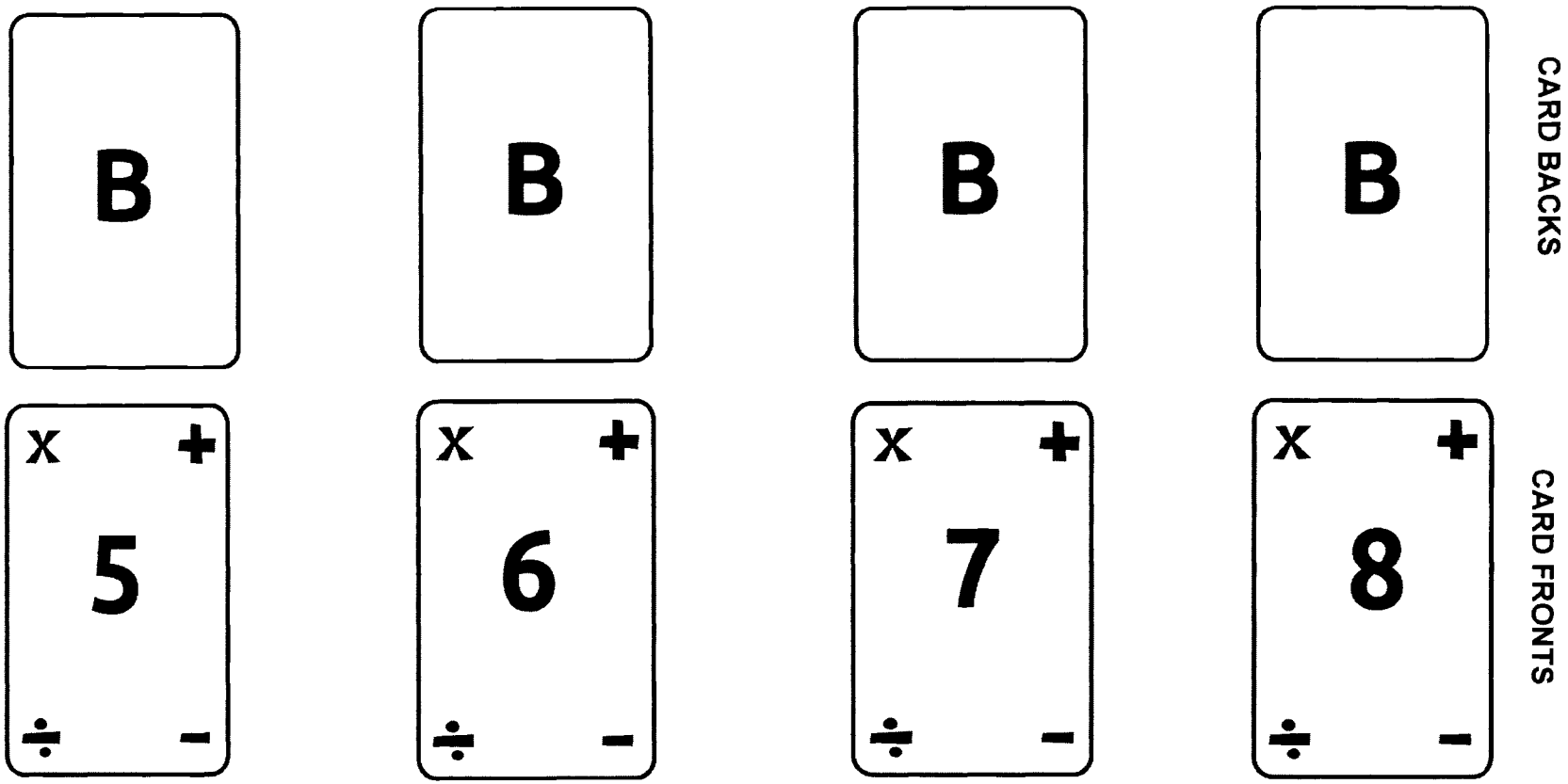
FIG. 3 - Exemplary Numbered Cards of Type B

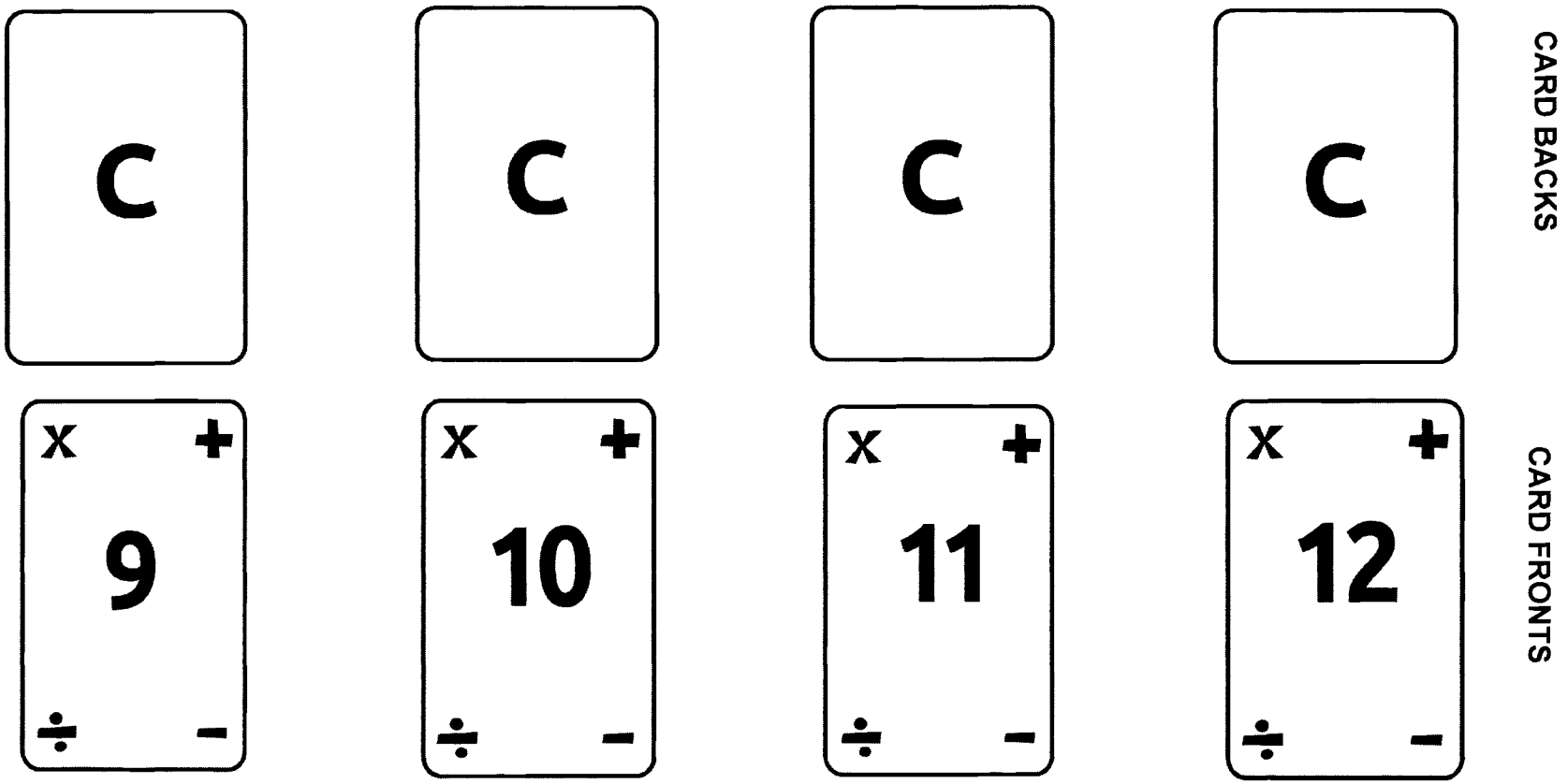
FIG. 4 - Exemplary Numbered Cards of Type C

GAME COUNTING NUMBERS CONSECUTIVELY USING MATH FUNCTIONS

CROSS REFERENCE TO RELATED APPLICATION

This application claims the benefit under 35 U.S.C. §119 (e) of U.S. Provisional Pat. App No. 61/305,915, filed Feb. 18, 2010, and entitled "Game Counting Numbers Consecutively Using Math Functions," which is incorporated herein by reference as if set forth in its entirety.

TECHNICAL FIELD

The present devices and methods relate generally to educational card games and games of skill, and more particularly to devices and methods of playing a game that involves counting numbers using mathematical functions.

BACKGROUND

Card games are commonly played for recreational and entertainment purposes. Popular card games include 21 or Blackjack, Poker, Bridge, and several others. Even a particular card game can have different variations of being played, and some even have different sets of rules associated with those variations.

Since most people have fun playing games, card games can also be used as a means of helping people learn new material or memorize information learnt earlier. Learning educational material, for example, subjects like Biology, History, Math and English, can be made more fun and interesting if matter for such subjects can be presented in the form of a game.

Card games having an educational component associated therewith are known in the art. Certain educational card games serve the purpose of illustrating difficult concepts to a player visually. Such card games typically provide stimulation to a player's brain, or, help in memorizing new study material. For example, they might help players learning the use of mathematical operations, or they may be used as flash cards to memorize subjects like Biology, History, etc.

Traditional card games usually have very rigid playing rules. For example, most of them are either self-playing card games (where the player plays by himself or herself), or have strict requirements on the number of players who can play the card game together. Because players who wish to play such a card game might not have a company of other players every time they want to play, this restricts the use of the game to certain times only. As a result, player(s) are unable to play and enjoy such a card game at all times. Another disadvantage of commonly played card games is that they are designed for pre-selected levels of difficulty so that they are rendered useless for people who intend to play at other levels of skill and mental maturity. In such situations, people have to find other games that are better suited to their cognitive interests and mental maturity levels.

In many situations, several card games associated with counting are permitted to be played inside (the premises of) a legal gaming establishments only. These gaming establishments are typically subject to the laws of a state, county or other political jurisdiction. As a result, such card games are less versatile as they cannot be played at all places universally.

Accordingly, card games have been designed before, but previous games have been limited to be played under specific conditions and rules, and cannot be adjusted to be played by people of all ages and mental maturity levels. Some card games can only be played at select locations, and some only when a predetermined number of players are available. Thus, there is a long-felt need for card games that can be played universally at all times and places, flexible enough to be played by one or more players with varied levels of mental maturity, and yet be entertaining and educational with minimal requirements.

BRIEF SUMMARY

Briefly described, and according to one embodiment, aspects of the present disclosure relate to counting games, particularly, educational counting games and games of skill that involves counting numbers using mathematical functions. A game involves drawing randomly a set of pre-classified numbers from one or more classes. Persons playing a game have to generate as large a number as possible, by using one or more math functions on the drawn numbers. A player with the highest generated number wins the game. Embodiments of the disclosed counting game are generally directed to playing games involving mental acuity drills, math education, critical and creative thinking, skills development, and attention building exercises. Embodiments also involve social interaction and competition among players who find developing math skills useful and enjoyable.

BRIEF DESCRIPTION OF THE DRAWINGS

FIG. 1 consisting of FIGS. 1A and 1B illustrates a flowchart showing the process of playing an exemplary game involving multiple players using numbered cards, according to an embodiment of the current disclosure.

FIGS. 2, 3, and 4 are illustrations of some exemplary embodiments of a set of numbered playing cards, according to an embodiment of the current disclosure.

DETAILED DESCRIPTION OF DISCLOSED EMBODIMENT

Embodiments of a counting game is discussed herein. This game is played by generating integers (from a number-generating source) that have been pre-classified as belonging to different types, and players perform one or more math functions on these integers to generate the same or different integers. A player who generates the highest integer wins the game. This game can be played by one or more players, having different levels of mental maturity.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. All limitations of scope should be determined in accordance with and as expressed in the claims.

Turning now to the drawings, in which like reference numerals indicate corresponding elements throughout the several views, attention is first is directed to FIG. 1, which shows the process of playing an exemplary card game involving more than one player. According to an embodiment of the disclosure, a game is played using numbered cards as illustrated in FIGS. 2, 3, and 4. At step 110, players mutually decide on an order in which they wish to play the game. In other words, they decide who plays first, who plays second, and so on. The players can choose any order to play a game. After having decided on an order, a player draws cards (without looking at the number on the face of the cards) randomly from a deck of cards at step 112, such that at least two (2) of the cards belong to a particular type. For the purpose of this discussion, this particular type is referred herein as Type A. As can be understood and appreciated, the number (2) is simply presented as an exemplary embodiment of the present disclosure. Alternate embodiments of the described game are not limited to use of two (2) cards or a specific type (viz. Type A, Type B etc.) of card, and various other combinations of cards and their respective types can be used to play a game. Further, there is no upper limit on the number of cards that can be drawn. If more numbers of cards are drawn, the level of difficulty of a game diminishes. This allows the game to be played by persons with different levels of mental maturity. For example, children studying in elementary school might want to draw a fairly large number of cards when playing a game, in contrast to adults that may want to only select a few cards.

Referring to FIG. 1, at step 114, a first player performs one or more math operation(s) on the numbers appearing on the face of the cards that were drawn previously in step 112 to generate a predetermined integer. According to one embodiment, a predetermined integer chosen is one (1), although there is no such restriction. In an embodiment, a player could use any combination of math operation(s) and drawn cards (picked at step 112) to arrive at the predetermined integer. Further, in another embodiment, the drawn cards can be manipulated one or more times. For illustrative purposes, hypothetical solutions of an exemplary hand played with four cards (numbered one (1) through twelve (12) are shown in Table 1 below).

At step 116, it is determined by a first player whether the operation(s) performed in step 114 were successful or not in arriving at the predetermined integer. If the first player is unsuccessful, then it is verified at step 124, whether there exists a next player in the game who has not had a chance to play once in the current hand already. In case there exists one or more such player(s), then a next player (according to the order established in step 110) is assigned the task of generating the same predetermined integer, at step 118. This continues until at least one player is able to successfully generate the predetermined integer correctly, at step 125. In case none of the players succeed, eventually the game terminates.

Still referring to FIG. 1, in case the first player is successful at step 114, then at step 120 a next player (in the established order of players from step 110) becomes a current player and performs one or more math operation(s) (on the numbers appearing on cards that were drawn in step 112) to generate another integer, consecutive to the predetermined integer. As discussed in the case of a first player, any combination of drawn cards and math function(s) can be used to arrive at this integer. At the following step 116, it is determined by the current player whether the operation(s) performed in step 120 is correct or not. In case the current player is unsuccessful, a next player (in the order of established players) becomes the current player and gets the chance of playing this game. If the current player is successful, a next player in the order of players becomes the current player and has to arrive at the next consecutive integer. The game thus continues in the manner, as recited previously, until at step 124 it is determined whether all players have played the game in the order that was established at step 110. As can be understood and appreciated, if the previous player was successful in performing his operation(s), the goal of a current player is to arrive at an integer consecutive to the integer arrived by the previous player using any number of cards drawn from the deck, and utilizing any combination of mathematical operation(s). In case the previous player is unsuccessful, the current player has to arrive at the same integer that the previous player failed in generating. After all players have played, it marks the end of a hand. A player who has successfully generated the highest integer in the current hand gets to keep the cards. As can be understood, a counting game can involve generating numbers that follow some other logical sequence, not necessarily consecutive.

Still referring to FIG. 1, at step 128, if the players wish to play another hand, they repeat the process as described above and the game continues until there are at least two (2) Type A cards remaining. This is verified at step 140. In case there is one (1) or none of Type A card(s) remaining in the deck, the game draws to an end and player(s) summarize the results of the game in the next steps.

Alternatively, at step 128, if the players decide not to play another hand, the results of the game are summarized. At step 130, each player counts the total number of cards (not the face value appearing on the cards) won respectively, throughout the game. As can be understood, it is possible for two or more players to win the same number of cards in the game. In such a case, they determine if there is a tie at step 132. In case of a tie, each player now adds up the face values of the cards won respectively, throughout the game, at step 134. The player with the highest score wins the game at step 136 and the game terminates. As can be understood and appreciated, the rule for winning the game depends on whether there is a tie or not at step 132. In case of a tie, the winner is decided by the player who wins the highest number of cards in the game. On the contrary, if there is not a tie, the player whose total sum (adding up the face values on the cards won) is the highest, wins the game.

The present disclosure is described as a card game that involves the use of math functions, wherein the player with the highest number of cards, or highest total sum (obtained from adding the numbers on the cards) wins the game. As can be understood, embodiments of the described counting game are not limited to use of card games. Alternate embodiments can use various other number-generating systems (e.g., dice, spinners, digital-computer generated numbers, or any other appropriate methods) to perform counting and math functions.

Further, a game can involve a timer in conjunction with numbers generated from a number-generating system (e.g., dice, spinners, digitally generated numbers, or any other appropriate methods). In one embodiment, a game is played using numbers and math functions to generate as large an integer as a player can, within a pre-determined time administered by a timer.

In another embodiment, a game can be implemented as a software program on a smartphone, electronic gaming device, digital computer, etc. and can be enabled to be played online as well. In an embodiment of a game played by several people, an overhead projector can be used to display the numbers on a large screen (or a blank wall) so that players can view the numbers.

Furthermore, in another embodiment, a score-sheet is used to record different plays of a counting game. A score-sheet can be designed on print, computer software, dry erase boards, or any other recordable medium.

Exemplary Embodiment

As recited previously in this disclosure, embodiments of the disclosed counting game involve a counting game where players randomly draw a set of numbers, and then employ math functions on the numbers drawn in order to generate numbers as large as a player can. A player with the highest generated number wins the game.

In an exemplary embodiment, a counting game involves a deck consisting of cards numbered one (1) through twelve (12), that can be exemplarily classified into three (3) types, referred herein as Type A, Type B, and Type C, as shown in FIGS. 2, 3, and 4 for illustrative purposes. A counting game is played by pre-selecting numbers to be classified as belonging to different types, and players perform one or math functions to generate integers. A player who generates the highest integer wins. In the context of this exemplary counting game using cards, cards numbered one (1) through four (4) are classified as Type A, cards numbered two (2) through eight (8) are classified as Type B, and cards numbered nine (9) through twelve (12) are classified as Type C. As can be seen from the figures, the front faces of cards show exemplary math operations: addition (+), subtraction (−), multiplication (×) and division (÷). However, as can be understood, cards can be used as factors or exponents and have different math functions associated with them, and are thus not limited to the specific embodiments shown and discussed.

As seen from FIGS. 2, 3 and 4, the back of the cards indicate their respective types. As can be understood and appreciated, a counting game can employ different number generating systems (e.g., dice, spinners, digitally generated numbers, or any other appropriate methods), coupled with various other math functions. Furthermore, classification of numbers (into various types) obtained from different number generating systems, can be done differently. Even when counting using numbered cards, other numbering schemes can be employed, or other types of classification can be done. The description of the embodiments discussed is presented for illustration purposes only, and is not intended to limit the disclosure presented herein.

Table 1 shows hypothetical solutions (shown here up to four possible solutions, although numerous other solutions are possible) of a card game involving a single hand with four cards numbered one (1) through four (4), drawn from a deck of cards numbered one (1) through twelve (12). An exemplary set of cards numbered one (1) through twelve (12) are illustrated in FIGS. 2, 3, and 4. Detailed steps involved in playing a card game is described with the help of a flowchart in FIG. 1.

TABLE 1

Exemplary Solutions of a Counting Game Involving a Hand with Numbers One (1) through Four (4)

| Count | Possible Solutions of Generating Count | | | |
|---|---|---|---|---|
| 1 = | 4 − 3 | 3 − 2 | 4 − 2 − 1 | |
| 2 = | 3 − 1 | 4/2 | 4/2 × 1 | 2 × 1 |
| 3 = | 1 + 2 | 3 × 1 | 4/2 + 1 | 4 − 3 + 2 |
| 4 = | 4 × 1 | 4/1 | 3 + 1 | 3 + 2 − 1 |
| 5 = | 3 + 2 | 3 + 2 = 1 | (3 × 2) − 1 | (4/2) + 3 |
| 6 = | 3 × 2 | 3 × 2 × 1 | 4 + 3 − 1 | 1 + 2 + 3 |
| 7 = | 4 + 3 | (4 + 3) × 1 | (4 × 2) − 1 | (3 × 2) + 1 |
| 8 = | 4 × 2 | 4 × 2 × 1 | (4 × 2)/1 | (3 + 1) × 2 |
| 9 = | (1 + 2) × 3 | 4 + 3 + 2 | (4 × 2) + 1 | 1 × (4 + 3 + 2) |
| 10 = | (1 + 4) × 2 | 4 + 3 + 2 + 1 | (3 × 2) + 4 | (4 × 3) − 2 |
| 11 = | (4 × 3) − 1 | (2 × 3) + 1 + 4 | (4 × 2) + 3 − 1 | |
| 12 = | 4 × 3 | (4 × 2) + 3 + 1 | 4 × 3 × 1 | 4 × 3/1 |
| 13 = | (4 × 3) + 1 | (4 + 3) × 2 − 1 | | |
| 14 = | (4 + 3) × 2 | (4 + 3) × 2 − 1 | 1 × (4 + 3) × 2 | |
| 15 = | (1 + 4) × 3 | (3 + 2) × (4 − 1) | | |
| 16 = | (l + 3) × 4 | (3 − 1) × 2 × 4 | | |

TABLE 1-continued

Exemplary Solutions of a Counting Game Involving a Hand with Numbers One (1) through Four (4)

| Count | Possible Solutions of Generating Count | | |
|---|---|---|---|
| 17 = | (1 + 5) × 3 + 2 | (4 + 2) × 3 − 1 | |
| 18 = | (4 + 2) × 3 | (2 × 3) × (4 − 1) | 1 × (4 + 2) × 3 |
| 19 = | (3 + 2) × 4 − 1 | (4 + 2) × 3 + 1 | |
| 20 = | (3 + 2) × 4 | (3 + 2) × 4 × 1 | (3 + 2) × 4/1 |
| 21 = | (3 + 2) × 4 + 1 | | |

*Each number can be used at most once for generating a count

In exemplary Table 1, each card has been used at most once in a solution to count a particular number. In other words, a player is not allowed to use the same card more than once, in counting a number. Referring to this example, a player could count one (1) by subtracting card "3" from card "4". Alternatively, a player could count one (1) by subtracting card "2" from card "3". Another possible way of counting one (1) would be by subtracting card "2" from card "4" first to obtain an intermediate value of two (2), followed by subtracting "1" from this intermediate value. As can be understood, there are other possible ways of counting one (1) using cards numbered one (1) through four (4), using each of these cards at most once.

In another instance, a player can count three (3) by adding card "1" with card "2". As can be seen from Table 1, there are at least two (2) other ways of counting three (3). A number four (4) can be counted by multiplying card "1" with card "4". In this game, a player can also perform more than one math operation to count a number. For example, a player can count ten (10) by adding card "1" with card "4" first, and then multiplying obtained value with card "2". As will be understood and appreciated by a person skilled in the art, a sequence of performing math operations is critical to arrive at the correct result. In another example, a player can count nineteen (19) by first adding card "2" with card "3" to arrive at a first intermediate value, multiplying first intermediate value by card "4" to arrive at a second intermediate value, and finally subtracting card "1" from second intermediate value. As can be understood and appreciated, numerous other solutions are possible to count a number in this counting game, using various combinations of the numbers drawn and the math function(s). As recited previously, a counting game can employ different number generating systems (e.g., dice, spinners, digitally generated numbers, or any other appropriate methods), and is not limited to be played by numbered cards. Additionally, various other math functions (e.g., factorials, exponents, etc.) can be used to play a game.

The foregoing description of the exemplary embodiments has been presented only for the purposes of illustration and description and is not intended to be exhaustive or to limit the disclosure to the precise forms disclosed. Many modifications and variations are possible in light of the above teaching. The embodiments were chosen and described in order to explain the principles of the systems and their practical application to enable others skilled in the art to utilize the systems and various embodiments and with various modifications as are suited to the particular use contemplated. Alternative embodiments will become apparent to those skilled in the art to which the present disclosure pertains without departing from their spirit and scope.

What is claimed is:

1. A computer-implementable method for use in connection with a mobile device having a processor, comprising the steps of:

a) presenting on the mobile device via the processor a plurality of digital representations of playing cards, each digital representation having displayed thereon an integer value, wherein each integer value is classified in at least one of three predetermined classification categories and wherein the plurality of digital representations of playing cards must include at least two digital representations of a particular predetermined classification category;

b) presenting on the mobile device via the processor a plurality of mathematical operators, wherein each of the mathematical operators indicates a particular mathematical operation that can be performed with respect to two or more of the plurality of digital representations;

c) providing via the processor a predetermined target value, wherein the predetermined target value is an integer N;

d) receiving at the processor a user-generated mathematical operation, wherein the mathematical operation comprises two or more of the plurality of digital representations and one or more of the mathematical operators, and wherein the mathematical operation is intended to produce an output equal to the predetermined target value;

e) determining via the processor whether the output of the mathematical operation is equal to the predetermined target value;

f) upon determination that the output of the mathematical operation is equal to the predetermined target value, generating via the processor a score value for the mathematical operation based on the two or more of the plurality of digital representations and one or more mathematical operators, wherein the score value comprises a predetermined measure of the complexity of the user-generated mathematical operation; and g) repeating steps a-f until a predetermined maximum score value is obtained or until the output fails to equal the predetermined target value a predetermined number of times, wherein each time steps a-f care repeated, the predetermined target value N is increased by 1.

2. The method of claim 1, wherein the integer values are non-repeating.

3. The method of claim 1, wherein the mathematical operators are selected from the group comprising: addition, subtraction, multiplication, and division.

4. The method of claim 1, wherein the predetermined target value is selected from a predetermined list.

5. The method of claim 4, wherein the predetermined target value is determined by a non-random sequence.

6. The method of claim 1, further comprising the step of providing via the processor a countdown timer.

7. The method of claim 6, further comprising the steps of: operating the timer for a predetermined period of time; and awarding a point value to a user at the end of the time period.

8. The method of claim 1, wherein the maximum score value is a summation of previous score values generated for previous mathematical operations.

9. The method of claim 1, wherein four, five, or six digital representations of playing cards are presented.

10. The method of claim 1, wherein the mathematical operation further comprises using each of the two or more of the plurality of digital representations once.

11. The method of claim 1, wherein the three predetermined classification categories comprise one or more groups of integers based on the value of each integer.

12. The method of claim 11, wherein the three predetermined classification categories comprise: a low category, a middle category, and a high category.

13. The method of claim 12, wherein each of the plurality of digital representations of playing cards are of a particular predetermined classification category.

14. The method of claim 13, wherein each of the plurality of digital representations of playing cards display the integer value and the particular predetermined classification category.

15. The method of claim 1, further comprising the step of receiving, at the processor, a user-defined number, wherein the user-defined number is the number of digital representations of the plurality of digital representations presented on the mobile device.

16. The method of claim 1, further comprising the step of receiving, at the processor, a user-defined number of players.

17. The method of claim 1, further comprising the step of, upon determination that the predetermined maximum score value has been obtained or the output has failed to equal the predetermined target value the predetermined number of times, presenting, on the mobile device, one or more statistics of one or more score values obtained during steps a-f.

18. The method of claim 17, wherein the one or more statistics comprise the number of times the output failed to equal the predetermined target value.

19. The method of claim 1, wherein N =1.

20. A computer-implementable method for use in connection with a mobile device having a processor, comprising the steps of:

a) receiving, at the processor, a user-defined number, wherein the user-defined number is a number of digital representations of a plurality of digital representations of playing cards to be presented on the mobile device;

b) in response to receiving the user-defined number, presenting on the mobile device, via the processor, the number of digital representations of playing cards, each digital representation:

being classified in at least one of three predetermined classification categories comprising a low category, a middle category, and a high category; and having displayed thereon an integer value and an indication of the predetermined classification category in which the digital representation is classified, wherein the presented plurality of digital representations of playing cards must include at least two digital representations of a particular predetermined classification category;

c) presenting on the mobile device via the processor a plurality of mathematical operators, wherein each of the mathematical operators indicates a particular mathematical operation that can be performed with respect to two or more of the plurality of digital representations;

d) providing via the processor a predetermined target value, wherein the predetermined target value is an integer N;

e) receiving at the processor a user-generated mathematical operation, wherein the mathematical operation comprises two or more of the plurality of digital representations and one or more of the mathematical operators, and wherein the mathematical operation is intended to produce an output equal to the predetermined target value;

f) determining via the processor whether the output of the mathematical operation is equal to the predetermined target value;

g) upon determination that the output of the mathematical operation is equal to the predetermined target value, generating via the processor a score value for the mathematical operation based on the two or more of the plurality of digital representations and one or more mathematical operators, wherein the score value comprises a predetermined measure of the complexity of the user-generated mathematical operation; and h) repeating steps a-g until a predetermined maximum score value is obtained or until the output fails to equal the predetermined target value a predetermined number of times, wherein each time steps a-g are repeated, the predetermined target value N is increased by 1.

* * * * *